United States Patent [19]

Lanvin

[11] 4,265,438

[45] May 5, 1981

[54] TUCKER CYLINDER

[75] Inventor: Serge Lanvin, Cires-les-Mello, France

[73] Assignee: Societe Marinoni, Montataire, France

[21] Appl. No.: 60,197

[22] Filed: Jul. 24, 1979

[30] Foreign Application Priority Data

Aug. 1, 1978 [FR] France ..... 78 22690

[51] Int. Cl.[3] ..... B65H 45/16

[52] U.S. Cl. ..... 493/428

[58] Field of Search ..... 270/70, 71, 72, 73, 270/74, 75

[56] References Cited

U.S. PATENT DOCUMENTS

| | | | |
|---|---|---|---|
| 2,211,791 | 8/1940 | Quicle et al. | 270/71 |
| 2,308,862 | 1/1943 | Confts | 270/71 |
| 2,555,267 | 5/1951 | Craftz | 270/72 |
| 3,124,349 | 3/1964 | Huffman | 270/73 |
| 3,195,882 | 7/1965 | Nystrand | 270/73 |
| 3,727,909 | 4/1973 | Greiner et al. | 270/71 |

FOREIGN PATENT DOCUMENTS

| | | | |
|---|---|---|---|
| 2025345 | 5/1971 | Fed. Rep. of Germany | 270/70 |
| 2732641 | 2/1978 | Fed. Rep. of Germany | 270/71 |

*Primary Examiner*—Edward M. Coven

*Attorney, Agent, or Firm*—Yount & Tarolli

[57] ABSTRACT

The disclosure relates to a tucker cylinder which cooperates with a folding cylinder to fold a sheet. The tucker cylinder is rotatable about a first axis and has a cylindrical outside surface and a circular end face. A tucker blade is connected to a carrier which is rotatable about a second axis within the tucker cylinder and parallel to and spaced from the first axis about which the tucker cylinder rotates. The carrier has a slot extending radially of the second axis, and a member fixed to the end face of the tucker cylinder slidably engaging the slot for transmitting rotary motion of the tucker cylinder to said carrier. An arcuate opening is formed in the end face through which the member extends. The arcuate opening is coaxial with the first axis of rotation of the tucker cylinder, and the member is adjustably positioned in the opening to adjust the timing of the motion of the tucker carrier.

7 Claims, 6 Drawing Figures

TUCKER CYLINDER

BACKGROUND OF THE INVENTION

The present invention relates to a tucker cylinder for use in a sheet-folding apparatus.

The general construction and mode of operation of sheet folders is well-known. These folders generally comprise one or more pairs of cylinders which are rotated about parallel axes and on which the folding takes place. A sheet of paper is engaged by a gripper or the like on a first cylinder and thereafter a tucker blade on the same cylinder inserts the sheet into a jaw on the second cylinder to form a fold. The jaw on the second cylinder closes onto the fold and the gripper on the first cylinder releases the end of the sheet. The folded sheet is released from the jaw to be conveyed into a stacker, a collater or other depository.

In some tucker mechanisms the tucker blade extends radially outward from the first cylinder. It may be fixed or it may move radially in and out at the proper time. Difficulties have been encountered with this type of mechanism because the tucker blade tends to pull the sheet out of the jaw of the second cylinder. The cylinder rotates. This is caused by the fact that the angle which the tucker blade on the first cylinder makes with jaws in the second cylinder changes as the pair of cylinders rotate so that the tucker blade at the time of withdrawal may be at a substantial angle to the opening formed by the jaw in the second cylinder. As the tucker blade is withdrawn at this steep angle it may tend to pull the sheet along with it and thus interrupt the folding operation.

These difficulties may be overcome in part by mounting the tucker blade to move radially with respect to the first cylinder but having the tucker blade itself disposed at a fixed angle with respect to the radius of the first cylinder. This, however, does not entirely solve the problem since under these conditions the tucker blade enters the jaw of the second cylinder at a steeper angle than before, and upon withdrawal it may still cause the folding machine to jam, especially when the paper must be inserted relatively deeply into the jaw.

Because of these difficulties considerable effort has been directed toward controlling the movement of the tucker blade. The motion of the tucker blade has been controlled by various types of cams and linkages so that it forms a substantially constant angle with the gap defined by the jaw of the second cylinder during the time that the sheet is being inserted by the tucker blade and the tucker blade is withdrawn. Examples of such mechanisms are found in Greiner U.S. Pat. No. 3,727,909 and Huffman U.S. Pat. No. 3,124,349.

SUMMARY OF THE INVENTION

The present invention makes it possible to eliminate the drawbacks of tucker blade mechanisms which are fixed or move only radially and the complexities of the cam operated tucker blades. The tucker cylinder of the present is adapted to have at least one tucker blade mounted therein which interacts with the jaws in a folding cylinder. According to the present invention the tucker blade is fixed to a blade carrier which rotates about an axis within the tucker cylinder and parallel to the axis of rotation of the tucker cylinder. The axis of rotation of the blade carrier is offset from the axis of rotation of the cylinder and is fixed relative to the frame which supports the cylinder. Means are provided which coact between the cylinder and the tucker carrier to cause the tucker carrier to rotate when the cylinder rotates.

The tucker carrier of the present invention is provided with a rectilinear slot at one axial end and the axis of which extends radially with respect to the axis of rotation of the carrier in a plane perpendicular to the axis of rotation of the carrier. A roller connected with the tucker cylinder extends into the slot and thus transmits rotation of the tucker cylinder to the carrier. Preferably, the roller which engages the slot is connected with a plate which is adjustably positioned on one of the end walls of the tucker cylinder. The plate is rotatable about the axis of rotation of the cylinder and fasteners are provided to fix the plate in a desired position, thus permitting angular adjustment of the roller relative to the tucker cylinder. It is also possible to reverse the roller and slot, having the roller extend from the carrier into a rectilinear radial slot provided in the end wall of the cylinder.

The tucker cylinder of the present invention may also include a plurality of identical tucker blades mounted in a regular angular array. In this case each blade is mounted on a carrier and all the carriers are rotatable about the same axis which is fixed relative to the frame of the machine and parallel to the axis of rotation of the tucker cylinder. In this case each of the carriers is provided with a rectilinear slot which extends radially of the axis of rotation of the carriers and in a plane normal thereto. A roller similar to that described above extends from the cylinder to engage each of the slots in the tucker blade carriers.

BRIEF DESCRIPTION OF THE DRAWINGS

Other features and advantages of the invention will become more apparent upon reading the following description of preferred embodiments of the invention with reference to the attached drawings in which.

DESCRIPTION OF PREFERRED EMBODIMENTS OF THE INVENTION

Figure 1A:
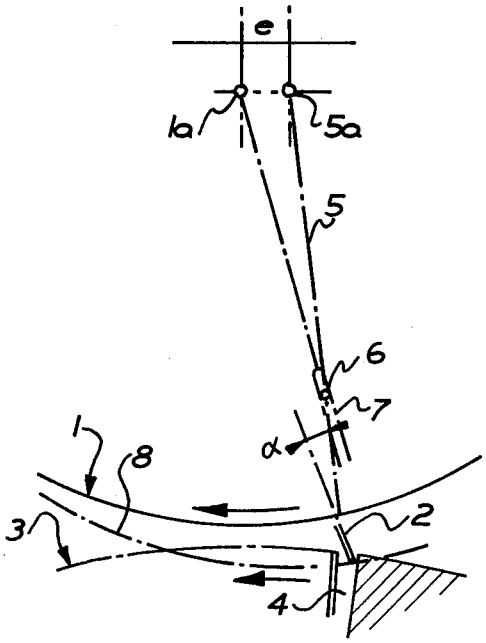
FIGS. 1*a*, 1*b*, and 1*c* are schematic views of a tucker cylinder constructed according to the present invention.
Figure 1B:
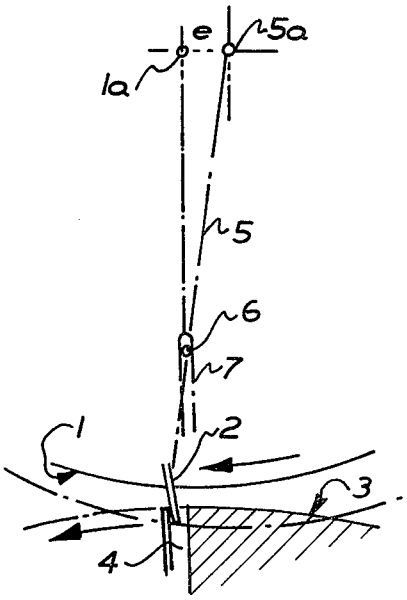
Figure 1C:
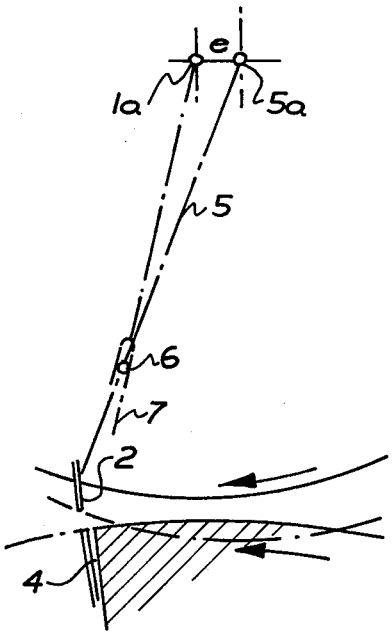

Referring to FIGS. 1*a*, 1*b*, and 1*c*, a folding machine includes a tucker cylinder 1 constructed according to the present invention. Tucker cylinder 1 rotates about an axis 1*a* and includes a tucker blade 2 for inserting a sheet of material into the jaws 4 of a gripper cylinder 3. The jaws 4 can be opened as shown in FIGS. 1*a* and 1*b* or closed as shown in FIG. 1*c* by means well-known to those skilled in the art. In the tucker cylinder 1 the blade carrier 5 is rotatable about an axis 5*a* which is fixed relative to the machine frame 10 and parallel to the axis 1*a*. The axis of rotation 5*a* of the blade carrier 5 is offset from the axis of rotation 1*a* of the cylinder 1 by a distance e.

Between the tucker blade 2 and the axis of rotation 5*a* of the blade carrier 5 is disposed a roller 6 which can slide in a yoke or slot 7. The slot 7 is fixed to the cylinder 1 and extends radially from the axis of rotation 1*a* of the cylinder 1. The tucker blade 2 is connected to its support 5 in such a manner that it forms a constant angle (alpha) with its support. When the cylinder 1 is rotated the slot 7 engages the roller 6 and causes the tip of the tucker blade 2 to trace out a path shown by phantom line 8 in FIG. 1*a*.

Due to the eccentricity e of the tucker blade 2 relative to the cylinder 1, the withdrawal of the tucker blade from the jaw 4 of the gripper cylinder 3 is effected more quickly than when the tucker blade is disposed directly on the cylinder 1 or when the blade inclination is controlled by a cam. Moreover this construction is simpler and more economical than previous known tucker blade constructions.

Figure 3:
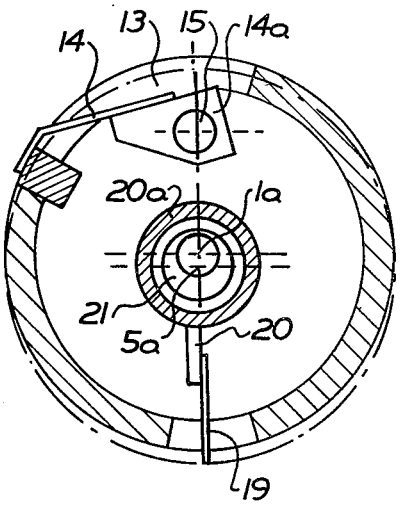
FIG. 3 is a crosssection taken along line 3—3 of FIG. 2.
Figure 2:
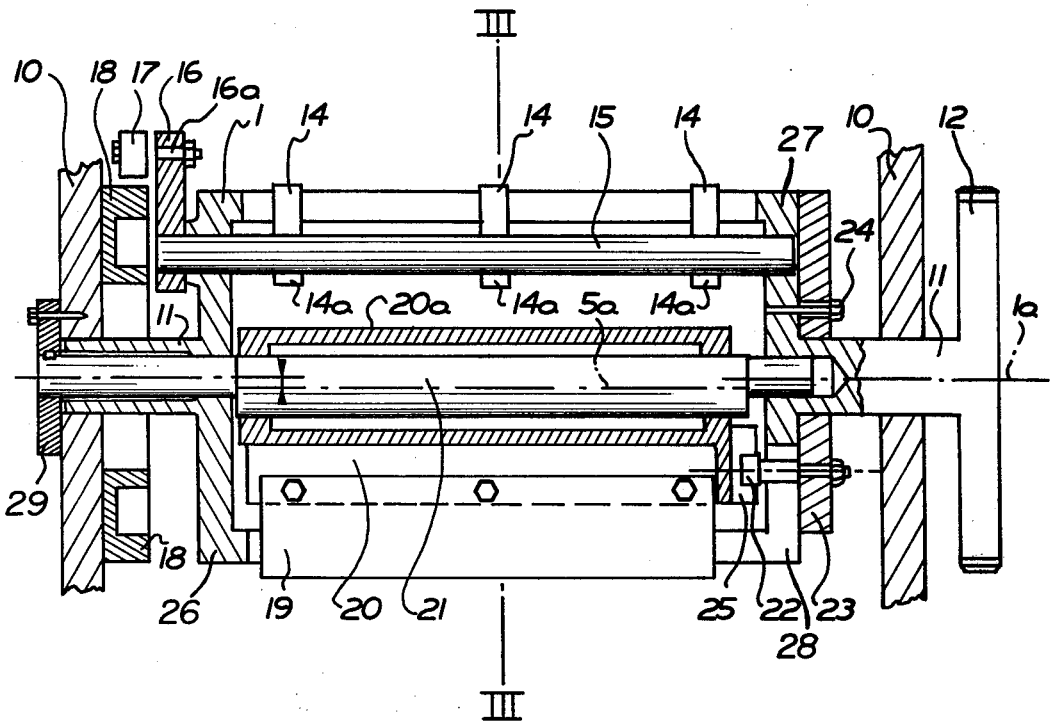
FIG. 2 is an axial crosssection of the tucker cylinder of the present invention.

FIGS. 2 and 3 illustrate a preferred embodiment of a tucker cylinder 1 equipped with an eccentric tucker blade 19 and constructed according to the present invention. The tucker cylinder 1 is mounted on a frame 10, and the shaft 11 carrying the tucker cylinder is supported in bearings (not shown) in the frame. The tucker cylinder 1 is rotated about the axis 1*a* of the shaft 11 by any known appropriate means, for example, by a gear driven by a motor (not shown) which engages the pinion 12 which is connected with the shaft 11.

The tucker cylinder 1 is a hollow cylinder and has at least one slot 13 through which one (or a plurality) of clamps 14 extend. The clamps 14 are mounted on a common shaft 15 which is parallel to the shaft 11 and supported at its ends by bearings mounted in the corresponding circular end walls 26 and 27 of the cylinder 1. The clamps are well-known and may be formed, for example, by attaching fingers 14 to the shaft 15 so that one end of the fingers engages an edge of the slot 13 in the cylinder 1 to grip a sheet.

The shaft 15 is rotated about its axis by means of a lever 16 connected with one end of the shaft which extends through the lateral end wall 26 of the cylinder 1. The lever 16 is equipped at its free end with a cam roller 17 which runs in a cam slot 18 connected with a machine frame 10. The roller 17 rotates freely about shaft 16*a* which is fastened to the lever arm 16 by any suitable means. When the cylinder 1 rotates about its longitudinal axis 1*a*, the shaft 15 is also caused to rotate about this axis and simultaneously the roller 17 follows the cam surface 18 causing the clamps 14 to open and close. The particular shape of the cam 18 is easily selected by one skilled in the art so that the shaft 15 does not rotate about its longitudinal axis during a certain period of rotation of the cylinder 1 so that a sheet may be held to the cylinder and thereafter the shaft 15 is rotated to release the sheet.

As is shown in FIGS. 2 and 3 the tucker blade 19 extends from the exterior of the cylinder 1 and is fixed by known means, for example by machine screws, to the blade carrier 20. The blade carrier includes a hollow cylindrical portion 20*a* which is freely rotatable about the longitudinal axis 5*a* of a shaft 21. The shaft 21 is adjustably fixed against rotation relative to the machine frame 10. To this end one of its ends is keyed by means of a clamp 26 which is attached to the frame 10.

The shaft 21 (FIG. 2) includes a central portion which is coaxial with the axis of rotation 5*a* of the tucker blade carrier 20. In addition, the shaft 21 includes two coaxial end portions which are coaxial with the axis of rotation 1*a* of the cylinder 1. These two parallel axes (1*a* and 5*a*) are spaced apart by a distance e. Thus the central portion of the shaft 21 around which the tucker blade carrier 20 rotates has an eccentricity relative to the two end portions which are located and rotatable with respect to the end walls 26 and 27 of the cylinder 1.

In addition, the tucker blade carrier 20 is equipped at one end with a groove or slot 25. As shown in FIG. 2, the axis of the slot 25 is located in the plane of the Figure and passes through the axis 5*a* of the shaft 21 to which it is perpendicular. A cam roller 22 which is adjustably connected to the end plate 27 of the cylinder 1 extends into the slot or groove 25. For purposes which will become clearer hereinafter, the roller 22 extends through an arcuate slot 28 in the end wall 27 and is fixedly connected to a plate 23. The plate 23 may be rotated about the axis 1*a* of rotation of the cylinder 1 and is normally held against rotation by bolt 24. Once fixed in place the roller 22 defines an axis of rotation which is parallel to and spaced from the axis of rotation 5*a* of the tucker carrier 5.

Upon rotation of the cylinder 1 the plate 23 is rotated and accordingly the cam roller 22 drives the tucker blade carrier 20 through engagement with the slot 25. This causes the tucker blade carrier 20 and the tucker blade 19 to rotate about the axis 5*a* of rotation of the central portion of the shaft 21. This axis 5*a* is parallel to and spaced from the axis of rotation 1*a* of the cylinder 1. The eccentricity e causes the slot 25 to slide relative to the roller 22 and the tucker carrier 20 to simultaneously rotate about an axis defined by the axis of the cam roller 22. Thus the roller 22 guides the sliding and rotating motion of the tucker carrier 20.

As discussed above the cam roller 22 is mounted on a plate 23 which is adjustable relative to the end wall 27 of the cylinder 1. It should be obvious now that adjustment of the roller 22 by loosening the bolt 24 and rotating the plate 23 relative to the end wall 27 of the cylinder 1 changes the timing by advancing or retarding the movement of the tucker blade 19 as it moves in and out. In a similar manner it is possible by rotation of the clamp 29 on the frame 10 to adjust the angular position of the eccentric shaft 21 to effect the orientation of the eccentricity relative to the frame 10 in any desired way. The first of these adjustments changes the angle between the plane containing axes 1*a* and 5*a* and the plane containing axis 1*a* and the axis defined by the roller 22 by moving the latter. The second of these adjustments varies the angle between the plane containing the axis of rotation of the roller 22 and the axis 1*a* and the plane containing axes 1*a* and 5*a* by moving axis 5*a*. Thus it is possible to obtain any desired timing of the motion of the tucker blade 19 relative to the machine frame 10.

Figure 4:
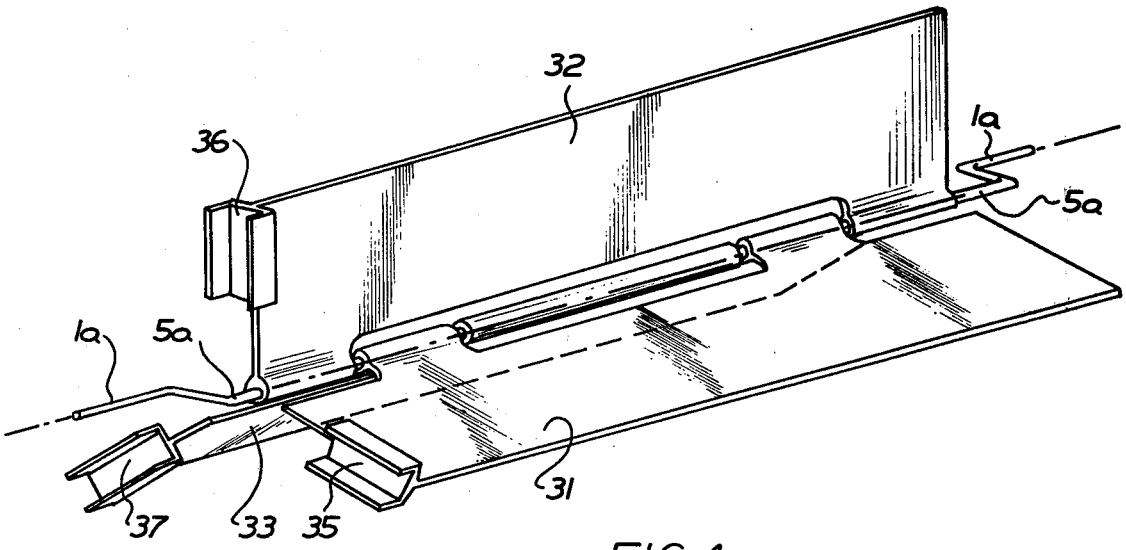
FIG. 4 is a perspective illustration of a tucker cylinder constructed according to the present invention which includes three tucker blade carriers.

Although the described embodiments have included only a single tucker blade 19 it is clear that a number of tucker blades could be included in the tucker cylinder 1 constructed according to the present invention. Thus in FIG. 4 is shown by way of example an assembly having three tucker blade carriers 31, 32, and 33 which are spaced equidistant from each other about the axis 5*a*. Of course, the cooperating gripper cylinder would have three gripping jaws to cooperate with the tucker blades connected with the tucker carriers 31, 32, and 33.

The three tucker carriers 31, 32, and 33 each have at one end a groove or slot 35, 36, and 37 which extends radially with respect to the axis 5*a* and lies in a plane perpendicular thereto. A tucker cylinder suitable for use with the assembly shown in FIG. 4 would have three equally spaced rollers similar to the roller 22 shown in FIG. 2. Furthermore, it is clear that the operation of such a tucker cylinder would be the same as the operation described for the tucker cylinder shown in FIG. 2.

It is within the scope of the present invention to effect the rotation of the tucker blades in some other way than by using the slots 25 and rollers 22 shown in FIG. 2. For example the rollers 22 could be attached and extend outward from one end of the tucker carrier 20 while the slots 25 could be formed in the end face 27 of the cylinder 1. Further the groove 25 and roller 22 could be replaced by suitable linkages.

The following is claimed:

1. A tucker cylinder rotatable about a first axis and which cooperates with a folding cylinder to fold a sheet, said tucker cylinder including a carrier for a tucker blade, said carrier being rotatable about a second axis which is parallel to and off set from said first axis, and guide means coacting between said tucker cylinder and said carrier for causing said carrier to rotate about said second axis when said tucker cylinder rotates about said first axis and for guiding said carrier in sliding and rotary motion relative to a third axis fixed with respect to said tucker cylinder and parallel to and spaced from said second axis.

2. A tucker cylinder as set forth in claim 1 wherein said guide means includes a slot formed in said carrier, said slot extending radially with respect to said second axis, and a member extending from said tucker cylinder into said slot and defining said third axis.

3. A tucker cylinder as set forth in claim 2 wherein said member is adjustably rotatable about said first axis, and means for securing said member in a fixed angular relationship to said tucker cylinder to thereby adjust the position of said third axis.

4. A tucker cylinder as set forth in claim 1 further including means for varying the angle of intersection of a plane which includes said first and second axis with a plane which includes said first and third axes by moving said second axis relative to said first and third axes.

5. A tucker cylinder as set forth in claim 4 further including means for varying the angle of intersection of a plane which includes said first and second axis with a plane which includes said first and third axes by moving said third axis relative to said first and second axis.

6. A tucker cylinder as set forth in claims 1, 2, 3, 4, or 5 further including a plurality of carriers each being rotatable about said second axis and equally spaced from each other thereabout, each of said carrier including a slot extending radially with respect to said second axis, and each of said slots being engaged by a member extending from said tucker cylinder, each of said members defining a third axis equally spaced from each other.

7. A tucker cylinder rotatable about a first axis and which cooperates with a folding cylinder to fold a sheet, said tucker cylinder having a cylindrical outside surface and a circular end face and including a tucker blade, a carrier connected with said tucker blade, said carrier being rotatable about a second axis within said tucker cylinder and parallel to and spaced from said first axis about which said tucker cylinder rotates, said carrier having a slot extending radially of said second axis, a member fixed to said end face of said tucker cylinder and slidably engaging said slot for transmitting rotary motion of said tucker cylinder to said carrier, an arcuate opening in said end face through which said member extends, said arcuate opening being coaxial with said first axis of rotation of said tucker cylinder, and means for adjustably positioning said member in said opening.

* * * * *